US008044754B2

(12) United States Patent
Ouyang et al.

(10) Patent No.: US 8,044,754 B2
(45) Date of Patent: Oct. 25, 2011

(54) TRANSFORMER FOR REDUCING ELECTROMAGNETIC INTERFERENCE AND POWER TRANSFORM CIRCUIT APPLIED THEREIN

(75) Inventors: Jr-Hong Ouyang, Taoyuan Hsien (TW); Chih-Hsun Hsu, Taoyuan Hsien (TW); Jui-Ling Lin, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/553,439

(22) Filed: Sep. 3, 2009

(65) Prior Publication Data

US 2010/0060255 A1 Mar. 11, 2010

(30) Foreign Application Priority Data

Sep. 5, 2008 (TW) ..... 97134198 A

(51) Int. Cl.
*H01F 27/28* (2006.01)
*H01F 17/04* (2006.01)

(52) U.S. Cl. ..... 336/182; 336/220; 336/221; 336/222

(58) Field of Classification Search ..... 336/220, 336/221, 222, 182
See application file for complete search history.

(56) References Cited

U.S. PATENT DOCUMENTS 2,553,324 A * 5/1951 Lord ..... 336/73
5,724,236 A * 3/1998 Oglesbee ..... 363/40
7,256,675 B2 * 8/2007 Chen ..... 336/180
2005/0012584 A1 * 1/2005 Park ..... 336/182
* cited by examiner

*Primary Examiner* — Anh Mai
*Assistant Examiner* — Ronald Hinson
(74) *Attorney, Agent, or Firm* — Kirton & McConkie; Evan R. Witt

(57) ABSTRACT

A transformer for reducing the electromagnetic interference (EMI) effect is disclosed. The transformer includes a bobbin; a magnetic core assembly partially sleeved by the bobbin; a first primary winding coiled around the bobbin; a secondary winding coiled on the first primary winding; and a first shielded element disposed between the first primary winding and the secondary winding for disconnecting the EMI transmission from the first primary winding to the secondary winding. The first primary winding includes a first winding portion and a second winding portion, and the first winding portion has larger EMI comparing to the second winding portion. The first winding portion of the first primary winding is adjacently disposed to the magnetic core assembly for shielding the EMI of the first primary winding by using the magnetic core assembly. The second winding portion is coiled on the first winding portion and adjacently disposed to the secondary winding for increasing the electromagnetic coupling rate of the first primary winding and the secondary winding. In addition, a power transform circuit applied in the transformer for reducing the EMI effect is also disclosed. The power transform circuit includes a switch, a power input for receiving a power signal; and a transformer electrically connected to the power input and the switch, for receiving and transforming the power signal.

9 Claims, 3 Drawing Sheets

TRANSFORMER FOR REDUCING ELECTROMAGNETIC INTERFERENCE AND POWER TRANSFORM CIRCUIT APPLIED THEREIN

FIELD OF THE INVENTION

The present invention relates to a transformer, and more particularly to a transformer for reducing electromagnetic interference (EMI). The present invention relates to a power transform circuit, and more particularly to a power transform circuit applied in a transformer for reducing EMI.

BACKGROUND OF THE INVENTION

Transformer is an electronic component for usually applying to various electronic apparatuses. Please refer to FIG. 1 which is a structure diagram illustrating a conventional transformer. As shown in FIG. 1, a conventional transformer 1 includes a magnetic core assembly 11, a bobbin 12, a primary winding 13 and a secondary winding (not shown in FIG. 1). The primary winding 13 and the secondary winding are coiled a winding region of the bobbin 12 by the sandwich-coiled type. That is, the primary winding 13 is separated to two portions covering the secondary winding, and the side-by-side adjacent region between the primary winding and the secondary winding are insulated by tape. Generally, the magnetic core assembly 11 is EE-core, EI-core or ER-core. The axle center 111 is disposed inside a channel 121 of the bobbin 12, for resulting in the magnetic core assembly 11 with the primary winding 13 and the secondary winding to generate the electromagnetic coupling induction for achieving the purpose of voltage transform.

Although the conventional transformer 1 certainly can achieve the effectiveness of voltage transform, there is still a problem need to be solved. When the transformer 1 is applied to a power transform circuit (not shown in FIG. 1), the primary winding 13 of the transformer 1 is electrically connected to a switch of the power transform circuit, and the current passing through the primary winding 13 is connected or broken off by controlling the switch. However, when the switch is repeatedly OFF and ON, the current passed through the primary winding 13 is changed largely. Thus, the electromagnetic interference (EMI) is generated. While the primary winding 13 is closer the switch, the EMI is the more significant. Furthermore, the generation of EMI will affect the electromagnetic coupling rate of the primary winding 13 and secondary winding and increase the leakage inductance of the transformer 1, resulting in lowering the operation efficiency of the transformer 1.

Therefore, the purpose of the present invention is to develop a transformer and a power transform circuit for reducing the effect of electromagnetic interference to deal with the above situations encountered in the prior art.

SUMMARY OF THE INVENTION

An object of the present invention is to provide a transformer for reducing the EMI effect.

Another object of the present invention is to provide a transformer for enhancing the electromagnetic coupling rate between primary windings and secondary windings, and increasing the transform efficiency.

An additional object of the present invention is to provide a power transform circuit applied in a transformer for reducing the EMI effect.

An additional object of the present invention is to provide a power transform circuit applied in a transformer for enhancing the electromagnetic coupling rate between primary windings and secondary windings, and increasing the transform efficiency of the transformer.

According to an aspect of the present invention, there is provided a transformer. The transformer includes a bobbin; a magnetic core assembly partially sleeved by the bobbin; a first primary winding coiled around the bobbin; a secondary winding coiled on the first primary winding; and a first shielded element disposed between the first primary winding and the secondary winding for disconnecting the EMI transmission from the first primary winding to the secondary winding. The first primary winding includes a first winding portion and a second winding portion, and the first winding portion has larger EMI comparing to the second winding portion. The first winding portion of the first primary winding is adjacently disposed to the magnetic core assembly for shielding the EMI of the first primary winding by using the magnetic core assembly. The second winding portion is coiled on the first winding portion and adjacently disposed to the secondary winding for increasing the electromagnetic coupling rate of the first primary winding and the secondary winding.

Preferably, the transformer further includes a second primary winding coiled on the secondary winding. The secondary primary winding includes a third winding portion and a fourth winding portion. Preferably, the first and second primary windings and the secondary winding are coiled by the sandwich-coiled type to make the secondary winding be coiled between the first and second primary windings. Preferably, the transformer further includes a second shielded element disposed between the second primary winding and the secondary winding, for preventing EMI of the second primary winding from transmitting to the secondary winding. Preferably, the first and second shielded elements are metal slices. Preferably, the EMI of the third winding portion is smaller than that of the fourth winding portion, the third winding portion coiled on the second shielded element is adjacently disposed to the secondary winding, and the fourth winding portion is coiled on the third winding portion, for increasing the electromagnetic coupling rate between the second primary winding and the secondary winding. Preferably, insulating materials are disposed between the first primary winding and the first shielded element, the secondary winding and the first shielded element, the secondary winding and the second shielded element, and the second primary winding and the second shielded element, respectively, to separate each other. Preferably, the insulating material is an insulating tape.

According to another aspect of the present invention, there is provided a power transform circuit. The power transform circuit includes a switch; a power input for receiving a power signal; and a transformer electrically connected to the power input and the switch, for receiving and transforming the power signal. The transformer includes a bobbin; a magnetic core assembly partially sleeved by the bobbin; a first primary winding coiled around the bobbin; a secondary winding coiled on the first primary winding; and a first shielded element disposed between the first primary winding and the secondary winding for disconnecting the EMI transmission from the first primary winding to the secondary winding. The first primary winding includes a first winding portion and a second winding portion. The first winding portion is electrically connected to the switch and has EMI larger than that of the second winding portion. The first winding portion of the first primary winding is adjacently disposed to the magnetic core assembly for shielding the EMI of the first primary winding by using the magnetic core assembly. The second winding portion is coiled on the first winding portion and adjacently disposed to the secondary winding for increasing the electromagnetic coupling rate of the first primary winding and the secondary winding.

Preferably, the transformer further includes a second primary winding coiled on the secondary winding. The second primary includes a third winding portion and a fourth winding portion. The third winding portion and the fourth winding portion are electrically connected to the power input and the first primary winding, respectively, and the EMI of the third winding portion is smaller than that of fourth winding portion. Preferably, the transformer further includes a second shielded element disposed between the second primary winding and the secondary winding, for disconnecting the EMI transmission from the second primary winding to the secondary winding. Preferably, the third winding portion of the second primary winding coiled on the second shielded element is adjacently disposed to the secondary winding. The fourth winding portion is coiled on the third winding portion, for increasing the electromagnetic coupling rate between the second primary winding and the secondary winding. Preferably, the power transform circuit further includes a jumper route electrically connected to the first and second shielded elements, and the switch, for forming a circuit having a minimum route among the first and second primary windings, the first and second shielded elements, and the switch to result in that the EMI of the first and second primary windings transmitting is limited among the minimum-route circuit, whereby reducing the EMI dispersion.

Preferably, the switch is an N-channel metal-oxide-semiconductor (NMOS) field-effect transistor.

BRIEF DESCRIPTION OF THE DRAWINGS

The present invention may best be understood through the following description with reference to the accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 2:
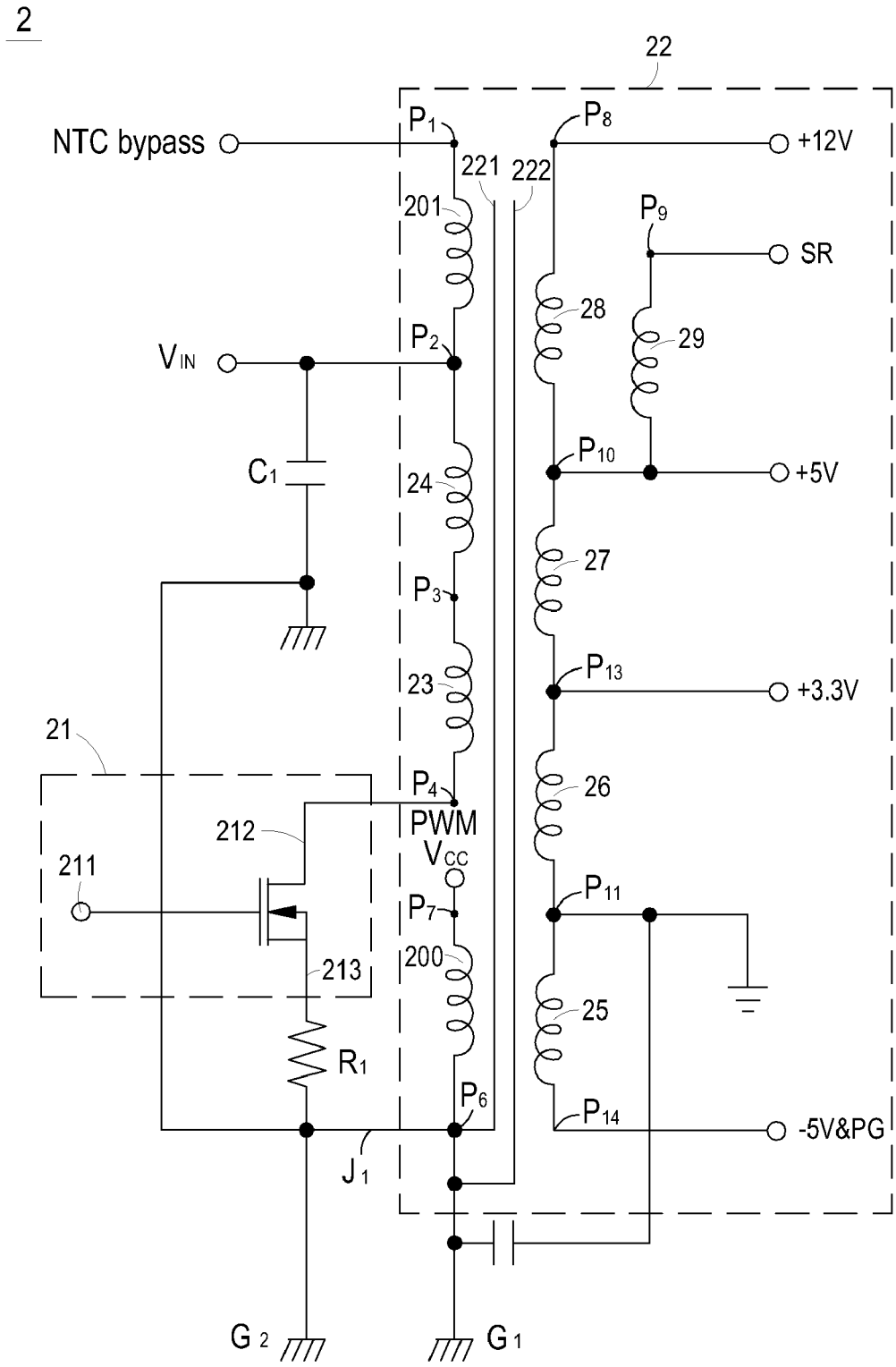
FIG. 2 is a circuit diagram illustrating a preferred embodiment of a power transform circuit according to the present invention.

FIG. 2 is a circuit diagram illustrating a preferred embodiment of a power transform circuit according to the present invention. As shown in FIG. 2, a power transform circuit 2 includes a power input $V_{IN}$, a switch 21, and a transformer 22. The transformer 22 is electrically connected to the power input $V_{IN}$ and the switch 21, respectively. The transformer 22 includes a primary winding, a secondary winding, a first shielded element 221, a second shielded element 222 and a plural of pins $P_1$~$P_4$, $P_6$~$P_{11}$ and $P_{13}$~$P_{14}$.

Figure 3:
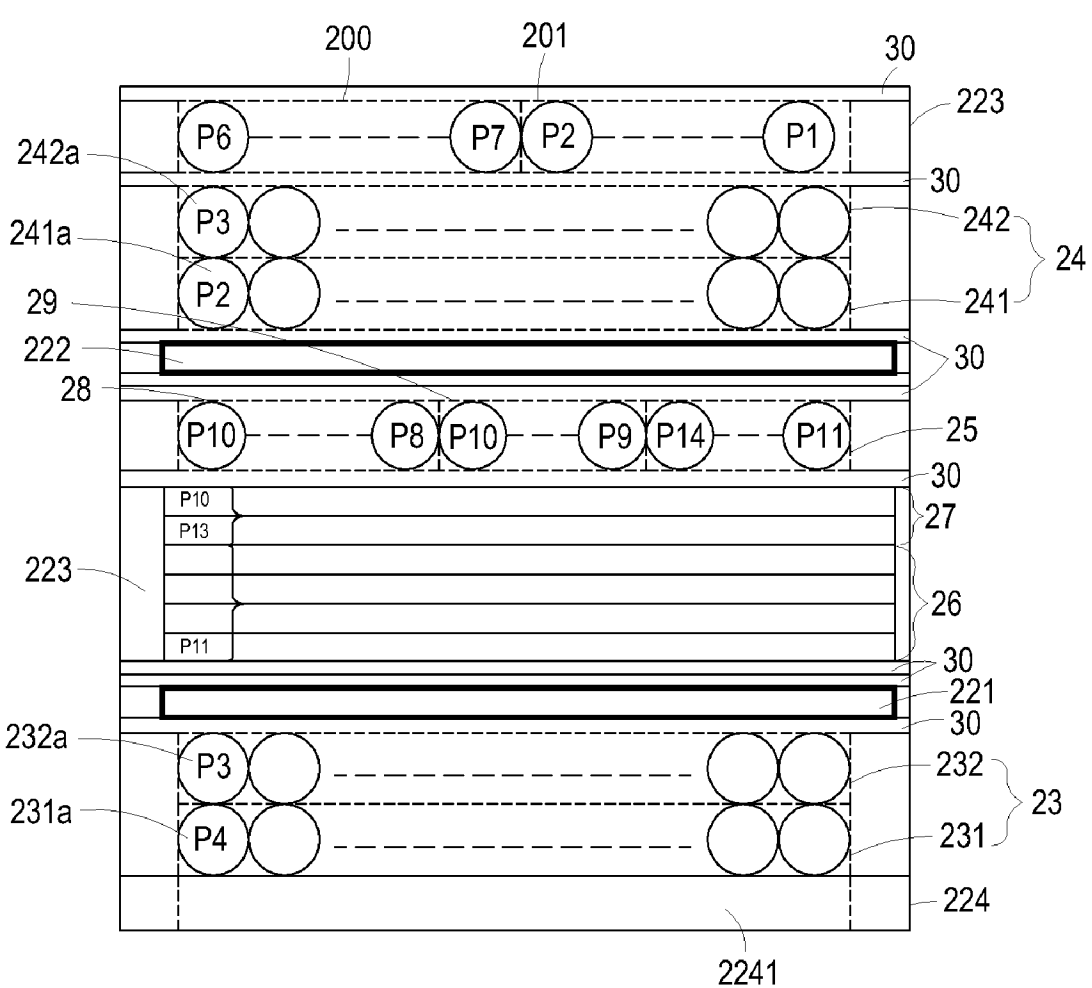
FIG. 3 is a sectional diagram illustrating an axle center of the transformer from the most exterior winding layer to the magnetic core assembly of FIG. 2.

In the preferred embodiment of FIG. 2, the primary winding can include a first primary winding 23 and a second primary winding 24, but not be limited to. The first primary winding 23 is respectively connected to the pins $P_4$ and $P_3$ of the transformer 22, while the second winding 24 is respectively connected to the pins $P_2$ and $P_3$ of transformer 22. Hence, the second primary winding 24 is electrically connected to the first winding 23 by the pin $P_3$. Moreover, the secondary winding can include a plural of secondary windings 25~29, but not be limited to. As shown in FIG. 2., the secondary windings 25~29 are in order connected to the pins $P_{14}$ and $P_{11}$, the pins $P_{11}$ and $P_{13}$, the pins $P_{13}$ and $P_{10}$, the pins $P_{10}$ and $P_8$, and the pins $P_{10}$ and $P_9$, respectively. Therefore, the electromagnetic coupling induction is generated among the first and second primary windings 23 and 24, and plural secondary windings 25~29 by a magnetic core assembly 224 (as shown in FIG. 3).

In the preferred embodiment, the circle number of the first primary winding 23 can be, for example, 26 circles, and the circle number of the second primary winding 24 is also 26 circles. In addition, the number of circle of plural secondary windings 25~29 can be, for example, 8, 4, 2, 8, and 6 circles, so the plural secondary windings 25~28 can generate −5V, 3.3V, 5V and 12V to output, respectively. However, the circle number of first and second primary windings 23 and 24, and plural secondary windings 25~29, and voltage output of the plural secondary windings 25~28 are not limited to the above description. It can be altered according to the real voltage request of the transformer 22.

In this preferred embodiment, the first shielded element 221 and second shielded element 222 are respectively disposed between first and second primary windings 23 and 24 and plural secondary windings 25~29 as shown in FIG. 2. On the other hand, in some preferred embodiments, the first and second shielded elements 221 and 222 can be, but not limited to, connected to the pin $P_6$ of the transformer 22 to connect the ground $G_1$.

As shown in FIG. 2, the transformer 22 can further includes a first auxiliary winding 200 and a second auxiliary winding 201. The first auxiliary winding 200 is connected to the pins $P_6$ and $P_7$, and electrically connected to the first and second shielded elements 221 and 222 by the pin $P_6$. The first auxiliary winding 200 is used for providing the required power of a pulse width modulation (PWM) controller (not shown in FIG. 2) to control the switch 21. The second auxiliary winding 201 is connected to the pins $P_1$ and $P_2$ of the transformer 22, and electrically connected to the first primary winding 23 by the pin $P_2$. The second auxiliary winding 201 is used for providing additional power to the internal elements of the power transform circuit 2.

As shown in FIG. 2, the power input $V_{IN}$ is connected to the pin $P_2$ of the transformer 22 to electrically connect to the second primary winding 24 and the second auxiliary winding 201. Furthermore, the power input $V_{IN}$ is electrically connected to the switch 21 through a capacitance $C_1$ and a resistance $R_1$. The power input $V_{IN}$ is used for receiving a power signal and providing the power signal to the first and second primary windings 23 and 24 and the first auxiliary winding 200 of the transformer 22.

The switch 21 is electrically connected to the power input $V_{IN}$ and the transformer 22, and can be an N-channel metal-oxide-semiconductor (NMOS) field-effect transistor but not be limited to. As shown in FIG. 2, the switch 21 includes a control terminal 211, a first current transmitting terminal 212 and a second current transmitting terminal 213. The control terminal 211 is used for receiving the control signal from the pulse width modulation (PWM) controller to control conduction or disconnection between the first current transmitting terminal 212 and the second current transmitting terminal 213. The first current transmitting terminal 212 is connected to the pin $P_4$ of the transformer 22 to electrically connect to the first primary winding 23, while the second current transmitting terminal 213 is connected to the ground $G_2$ by a resistance $R_1$. Therefore, when the power input $V_{IN}$ of the power transform circuit 2 receives a power signal, the power transform circuit 2 can control the current to pass through the first and second primary windings 23 and 24 by controlling the switch 21 to turn ON or OFF, resulting in the induction of the plural secondary windings 25~29 of the transformer 22 to generate various voltage outputs.

Figure 1:
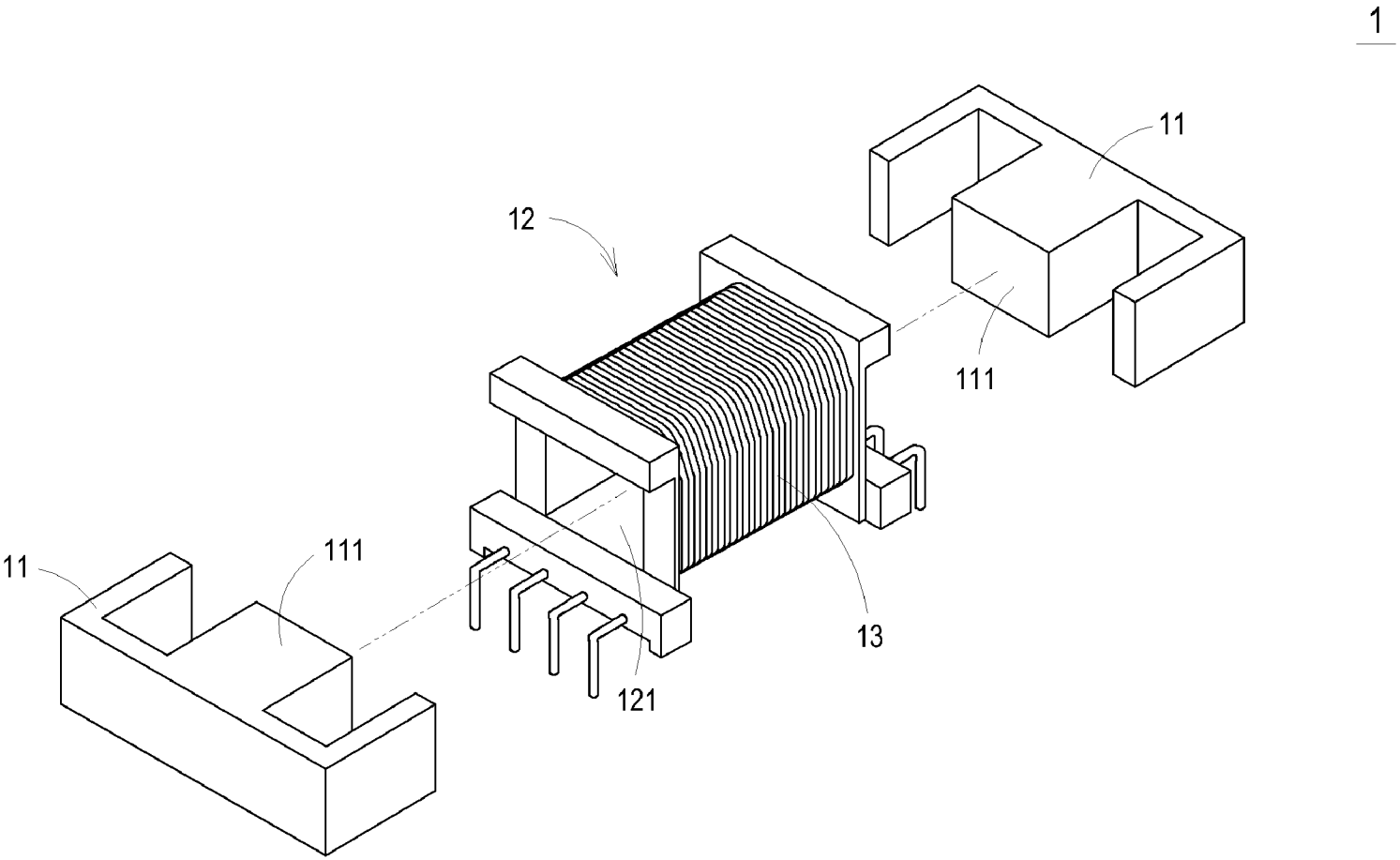
FIG.1 PRIOR ART
FIG. 1 is a structure diagram illustrating a conventional transformer.

FIG. 3 is a sectional diagram illustrating an axle center of the transformer from the most exterior winding layer to the magnetic core assembly of FIG. 2. Please refer to FIG. 2 and FIG. 3 at same time. In this preferred embodiment, the 3-D structure appearance of the transformer 22 is similar to that of the conventional transformer 1 of FIG. 1. In other words, the transformer 22 is divided into two regions, the first and second regions, by using the axis of the magnetic core assembly as an axle. The first region includes from the most outer winding of the transformer 22 to the axis 2241 of the magnetic core assembly 224, while the second region, corresponding to the first region, includes from the axis 2241 of the magnetic core assembly 224 to other the most outer winding of the transformer 22. Since the first region and second region displays a mirror image symmetry by using the axis 2241 of the magnetic core assembly 224 as an axle, the detail structure of the transformer 22 of the preferred embodiment according to the present invention in FIG. 3 is described by using the first region only. In addition, in order to easier understand the present invention, the pins' labels correspondingly connecting to the two ends of the first primary winding 23, the second primary winding 24, the first auxiliary winding 200, the second auxiliary winding 201 and plural secondary windings 25~29 are directly indicated in FIG. 3.

Please refer to FIG. 3 and FIG. 2. The transformer 22 includes a first primary winding 23, a second primary winding 24, and a plural of secondary windings 25~29, a first shielded element 221, a second shielded element 222, a bobbin 223 and a magnetic core assembly 224. In this embodiment, the 3-D structures of the bobbin 223 and the magnetic core assembly 224 are similar to those of the conventional bobbin 12 and magnetic core assembly 11 in FIG. 1. The bobbin 223 is used for the first primary winding 23, the second primary winding 24, and the plural secondary windings 25~29 to coil thereon. Furthermore, the coiling way can be the sandwich-coiled type, but it is not limited to. That is, the plural secondary windings 25~29 are wrapped between the first primary winding 23 and the second primary winding 24 as shown in FIG. 3. The axis 2241 of the magnetic core assembly 224 is partially disposed into the channel (not shown in FIG. 3) of the bobbin 223 to position in the center of bobbin 223, to make the first primary winding 23, the second primary winding 24, and the plural secondary windings 25~29 generate electromagnetic coupling induction for achieving the purpose of the voltage transform of the transformer 22.

In this embodiment, the first primary winding 23 is coiled on the bobbin 223 and includes a first winding portion 231 and a second winding portion 232. The end 231*a* of the first winding portion 231 is connected to the pin $P_4$ of the transformer 22 to electrically connect to the first current transmitting terminal 212 of the switch 21. The second winding portion 232 is coiled on the first winding portion 231 and has the end 232*a* to connect to the pin $P_3$ of the transformer 22.

In this embodiment, the first shielded element 221 can be a metal slice, but not be limited to, and is coiled on the first primary winding 23. As shown in FIG. 3, an insulating material 30, such as insulating tape, is disposed between the first shielded element 221 and the first primary winding 23, for achieving the effect to separate the first shielded element 221 and the first primary winding 23.

Please refer to FIG. 3. The secondary windings 26 and 27 are respectively coiled on the first shielded element 221, and the other secondary windings 25, 28, and 29 are coiled on the secondary windings 26 and 27. The second shielded element 222 is disposed on the plural secondary windings 25~29, and can be a metal slice but not be limited to. In some embodiments, the insulating materials 30 are disposed between the secondary windings 25~29 and the first shield element 221, and the secondary windings 25~29 and the second shielded element 222, respectively, to separate each other. In addition, the insulating material 30 is also disposed between the secondary windings 25, 28 and 29 and the secondary winding 27 to achieve the separation effect.

In this embodiment, the secondary winding 24, including a third winding portion 241 and a fourth winding portion 242, is coiled on the second shielded element 222. The end 241*a* of the third winding portion 241 is connected to the pin $P_2$ to electrically connect to the power input $V_{IN}$ of the power transform circuit 2. Furthermore, the third wining portion 241 is adjacently disposed to the second shielded 222 and near the plural secondary windings 25~29. The fourth winding portion 242 is coiled on the third winding portion 241 and electrically connected to the first primary winding 23 by connecting the end 242*a* thereof to the pin $P_3$ of transformer 22. Certainly, in another embodiment, the insulating material can be disposed between the second primary winding 24 and the second shielded element 222 to separate each other.

As shown in FIG. 3, the first auxiliary winding 200 and the second auxiliary winding 201 are coiled on the second primary wining 24 and disposed the most outer layer of the transformer 22. The insulating materials 30 are respectively disposed on the two sides of the first and second auxiliary windings 200 and 201. That is, the first and second auxiliary windings 200 and 201 and the second primary winding 24 can be separated by the insulating material 30. Since the first and second auxiliary windings 200 and 201 are disposed on the most outer layer of the bobbin 223 of the transformer 22 to wrap up the first and second primary windings 23 and 24, the plural secondary windings 25~29, and the first and second shielded elements 221 and 222, the electromagnetic coupling rate can be enhanced between the first and second primary windings 23 and 24 and the plural secondary windings 25~29 besides the structure of the transformer 22 is tighter.

Please refer FIGS. 2 and 3. When the switch 21 of the power transform circuit 2 is repeatedly switched by the control signal received by the control terminal 211, the huge EMI is generated at the first primary winding 23 and the second primary winding 24. Furthermore, the end 231*a* of the first winding portion 231 of the first primary winding 23 is electrically connected to the first current transmitting terminal 212 of the switch 21 directly, so the EMI of the first winding portion 231 is relatively greater than that of the second winding portion 232. However, since the first winding portion 231 is directly coiled on the bobbin 223 and disposed at the most internal layer of the transformer 22 near the magnetic core assembly 224, the EMI generated at the first winding portion 231 of the transformer 22 can be shielded by the axis 2241 of the magnetic core assembly 224, for reducing the EMI effect on the internal elements of the transformer 22. In addition, the second winding portion 232 having smaller EMI is coiled on the first winding portion 231 and adjacent to the plural secondary windings 25~29, so the electromagnetic coupling rate can be enhanced between the first primary winding 23 and the plural secondary windings 25~29.

Moreover, the end 241*a* of the third winding portion 241 of the second primary winding 24 is electrically connected to the power input $V_{IN}$ of the power transform circuit 2, for receiving the power signal transmitted by the power input $V_{IN}$. In comparison with the third winding portion 241, the fourth winding portion 242 is more close to the first current transmitting terminal 212 of the switch 21. Therefore, the EMI of the third winding portion 241 is smaller than that of the fourth winding portion 242. Since the third winding portion 241 is disposed on the second shielded element 222 and adjacent to the plural secondary windings 25~29 while the fourth winding portion 242 is coiled on the third winding portion 241 and far away from the plural secondary windings 25~29, the electromagnetic coupling rate can be enhanced between the second primary winding 24 and the plural secondary windings 25~29.

In addition, the first and second shielded elements 221 and 222 have the effect to reduce the EMI affecting the transformer 22. As shown in FIG. 3, since the first and second shielded elements 221 and 222 are disposed between the first primary winding 23 and the plural secondary windings 25~29, and the second winding 24 and the plural secondary windings 25~29, respectively, the EMI of the first and second primary windings 23 and 24 are respectively transmitted to the first and second shielded elements 221 and 222. Furthermore, the first and second shielded elements 221 and 222 are connected to the ground $G_1$, so the EMI is transmitted out by the ground $G_1$. Therefore, the EMI of the first and second primary windings 23 and 24 can be separated and prevented from transmitting to the plural secondary windings 25~29, resulting in the electromagnetic coupling rates between the first and second primary windings 23 and 24 and the plural secondary windings 25~29 are increased for enhancing the transform effect of the transformer 22.

Please refer to FIG. 2. The power transform circuit 2 further includes a jumper route $J_1$ having one end to connect to the first and second shielded elements 221 and 222 and the other end to electrically connect to the switch 21 through the resistance $R_1$. The jumper route $J_1$ is used for forming the shortest circuit among the first and second shielded elements 221 and 222, the switch 21 and the first and second primary windings 23 and 24, resulting in the EMI generated from the first and second primary windings 23 and 24 can be transmitted in the shortest circuit repeatedly. Therefore, the EMI is unable to disperse to other routes of the power transform circuit 2, so the transform effect of the transformer 22 can be enhanced.

To sum up, the transformer and the power transform circuit applied thereto according to the present invention includes the first winding portion of the first primary winding having the largest EMI adjacently disposed to the magnetic core assembly, the second winding portion thereof and the third winding portion of the second primary winding having smaller EMI respectively and adjacently disposed to the plural secondary windings, and the first and second shielded elements respectively disposed between the first primary winding and the plural secondary windings, and the second primary winding and the plural secondary windings, for reducing the EMI effect on the transformer. Furthermore, the electromagnetic coupling rates between the first and second primary windings and the plural secondary windings can be increased, so the leakage inductance of the transformer can be reduced for enhancing the transform effect.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer comprising: a bobbin; a magnetic core assembly partially sleeved by said bobbin; a first primary winding coiled around said bobbin and including a first winding portion and a second winding portion, wherein said first winding portion has larger electromagnetic interference (EMI) comparing to said second winding portion; a secondary winding coiled on said first primary winding; a second primary winding coiled on said secondary winding and including a third winding portion and a fourth winding portion; a first shielded element disposed between said first primary winding and said secondary winding for disconnecting the EMI transmission from said first primary winding to said secondary winding, wherein said first winding portion of said first primary winding is adjacently disposed to said magnetic core assembly for shielding the EMI of said first primary winding by using said magnetic core assembly, said second winding portion is coiled on said first winding portion and adjacently disposed to said secondary winding for increasing the electromagnetic coupling rate of said first primary winding and said secondary winding; and a second shielded element disposed between said second primary winding and said secondary winding, for preventing EMI of said second primary winding from transmitting to said secondary winding; and a first auxiliary winding coiled on said second primary winding and disposed on the most outer layer of said transformer; wherein the EMI of said third winding portion is smaller than that of said fourth winding portion, said third winding portion coiled on said second shielded element is adjacently disposed to said secondary winding, and said fourth winding portion is coiled on said third winding portion, for increasing the electromagnetic coupling rate between said second primary winding and said secondary winding.

2. The transformer according to claim 1 wherein said first and second primary windings and said secondary winding are coiled by the sandwich-coiled type to make said secondary winding be coiled between said first and second primary windings.

3. The transformer according to claim 1 wherein said first and second shielded elements are metal slices.

4. The transformer according to claim 1 wherein insulating materials are disposed between said first primary winding and said first shielded element, said secondary winding and said first shielded element, said secondary winding and said second shielded element, and said second primary winding and said second shielded element, respectively, to separate each other.

5. The transformer according to claim 4 wherein said insulating material is an insulating tape.

6. A power transform circuit comprising: a switch; a power input for receiving a power signal; and a transformer electrically connected to said power input and said switch, for receiving and transforming said power signal, wherein said transformer comprises: a bobbin; a magnetic core assembly partially sleeved by said bobbin; a first primary winding coiling around said bobbin and including a first winding portion and a second winding portion, wherein said first winding portion is electrically connected to said switch and has EMI larger than that of said second winding portion; a secondary winding coiling on said first primary winding; a second primary winding coiled on said secondary winding and including a third winding portion and a fourth winding portion; a first shielded element disposed between said first primary winding and said secondary winding for disconnecting the EMI transmission from said first primary winding to said secondary winding, wherein said first winding portion of said first primary winding is adjacently disposed to said magnetic core assembly for shielding the EMI of said first primary winding by using said magnetic core assembly, said second winding portion is coiled on said first winding portion and adjacently disposed to said secondary winding for increasing the electromagnetic coupling rate of said first primary winding and said secondary winding; and a second shielded element disposed between said second primary winding and said secondary winding, for preventing EMI of said second primary winding from transmitting to said secondary winding; and a first auxiliary winding coiled on said second primary winding and disposed on the most outer layer of said transformer; wherein the EMI of said third winding portion is smaller than that of said fourth winding portion, said third winding portion coiled on said second shielded element is adjacently disposed to said secondary winding, and said fourth winding portion is coiled on said third winding portion, for increasing the electromagnetic coupling rate between said second primary winding and said secondary winding.

7. The power transform circuit according to claim 6 wherein said third winding portion and said fourth winding portion are electrically connected to said power input and said first primary winding.

8. The power transform circuit according to claim 6 further comprising a jumper route electrically connected to said first and second shielded elements, and said switch, for forming a circuit having a minimum route among said first and second primary windings, said first and second shielded elements, and said switch to result in that the EMI of said first and second primary windings transmitting is limited among said minimum-route circuit, whereby reducing the EMI dispersion.

9. The power transform circuit according to claim 6 wherein said switch is an N-channel metal-oxide-semiconductor (NMOS) field-effect transistor.

* * * * *